United States Patent [19]

Aufmkolk

[11] Patent Number: 4,899,709

[45] Date of Patent: Feb. 13, 1990

[54] ELECTRIC CONTROLLING ELEMENT FOR THE POWER-SETTING ELEMENT OF AN INTERNAL COMBUSTION ENGINE

[75] Inventor: Rudolf Aufmkolk, Kelkheim, Fed. Rep. of Germany

[73] Assignee: VDO Adolf Schindling AG, Frankfurt am Main, Fed. Rep. of Germany

[21] Appl. No.: 306,885

[22] Filed: Feb. 2, 1989

[30] Foreign Application Priority Data

Apr. 6, 1988 [DE] Fed. Rep. of Germany ..... 3811515

[51] Int. Cl.[4] ..... F02D 7/00

[52] U.S. Cl. ..... 123/399; 180/179

[58] Field of Search ..... 123/399, 361, 198 D, 123/400, 347; 180/179; 364/426.04

[56] References Cited

U.S. PATENT DOCUMENTS

| | | | |
|---|---|---|---|
| 4,120,373 | 10/1978 | Fleischer | 180/179 |
| 4,523,565 | 6/1985 | Ounisu | 123/399 |
| 4,655,180 | 4/1987 | Bauer et al. | 123/361 |
| 4,809,659 | 3/1989 | Tanaki et al. | 123/399 |

*Primary Examiner*—Raymond A. Nelli

*Attorney, Agent, or Firm*—Martin A. Farber

[57] ABSTRACT

In an electric controlling member for the power-setting element of an internal combustion engine in which a clutch having an electromagnet is arranged between a drive device and the power-setting element of the engine. Upon the passage of current through said electromagnet, an armature is attracted against the force of a spring, the clutch being thereby closed. A switch is provided which can be actuated as a function of the distance between the electromagnet and the armature.

8 Claims, 1 Drawing Sheet

ELECTRIC CONTROLLING ELEMENT FOR THE POWER-SETTING ELEMENT OF AN INTERNAL COMBUSTION ENGINE

FIELD AND BACKGROUND OF THE INVENTION

The present invention relates to an electric controlling element for the power-setting element of an internal combustion engine in which the controlling element operates a power setting element such as a throttle valve, the controlling element including a drive device and a clutch having an electromagnet arranged between the drive device and the power-setting element and wherein, upon passage of current to said electromagnet, an armature is attracted against the force of a spring, the clutch being thereby closed.

Such known controlling elements are used in systems for regulating the speed of motor vehicles, the vehicle maintaining a preselected speed by automatic displacement of the power-setting element, for instance the throttle valve. Furthermore, such controlling elements can also be used to control the speed of the vehicle, the position of the gas pedal being transmitted electrically to the power-setting element (so-called E-gas systems).

In one known electric controlling element a drive device is provided which consists of an electric motor, a gearing and a spindle drive and moves a plunger magnet linearly. The plunger magnet cooperates with an armature plate which is connected, as clutch, via a pull cable to the throttle valve. In normal operation, the clutch which consists of the plunger magnet and the armature plate is closed, so that the linear movement produced by rotation of the spindle is transmitted to the pull cable and thus to the throttle valve. This movement takes place in opposition to the force of a return spring which seeks to pull the throttle valve into the idling position.

The clutch formed by the plunger magnet and the armature plate has the task of maintaining the force lock between the drive device and the throttle valve under normal operation but to disconnect rapidly the drive device from the throttle valve if the vehicle brake or clutch is actuated. For this purpose, the current is disconnected from the winding of the plunger magnet so that the return spring can move the throttle valve into its idling position. The clutch is furthermore opened in the event of an error in the control or regulating system or if, for instance, the operating voltage fails.

In the known controlling element, limit switches are provided which are actuated when the plunger magnet reaches its end positions. In this way, the drive device can be disconnected when the end positions are reached. In the known controlling element it may happen that when the clutch is open, the current is again connected through the winding of the plunger magnet and, upon a corresponding movement of the gas pedal or corresponding control by the speed governor system, the plunger magnet approaches the armature plate and attracts it, as a result of which the throttle valve is suddenly opened. This, in its turn, can lead to a dangerous situation.

SUMMARY OF THE INVENTION

It is an object of the present invention, therefore, to permit the closing of the clutch only when the plunger magnet is in the idling position.

According to the invention, a switch (e.g. 5) is provided which can be actuated as a function of the distance between the electromagnet (3) and the armature (7).

Due to the fact that the electric circuit of the electromagnet is made dependent in suitable manner on the position of the switch, assurance is had that after an opening of the clutch, the plunger magnet must first be brought towards the armature plate up to the idling position before re-engagement takes place.

Another advantage of the electric controlling element in accordance with the invention is that, by means of the switch, the opening of the clutch can be reported to the control device. Such unintended opening takes place, for instance, if, due to a defect, the throttle valve, the pull cable or the armature plate becomes jammed, and the drive device controls the plunger magnet in the direction towards the opening of the throttle valve and thus forcefully opens the clutch. In this case, the corresponding report of a disturbance is produced by the actuating of the switch.

According to a further feature of the invention, the drive device (1, 2) produces a linear movement.

Another feature is that the drive device (1, 2) comprises an electric motor, a gearing and a spindle.

Further according to the invention, the electromagnet is developed as a plunger magnet (3) and the armature as an armature plate (7), the switch (5) being arranged in the plunger magnet (3).

Also by another feature of the invention, the switch (5) is conductive when the armature (7) contacts the electromagnet (3).

Still further, the switch is formed by a reed contact.

A particularly simple electrical connection between the switch and the winding of the electromagnet consists, in accordance with one advantageous embodiment of the invention, in that the switch (5) is connected in series with a winding (6) of the electromagnet (3) and a controllable switch (16).

Another feature of this embodiment permits in simple manner a report of the position of the switch to a control unit serving for the control in the manner that a first pole (18) of a source of operating voltage can be connected via the controllable switch (16) to a first terminal (17) of the winding (6), that the switch (5) is arranged between the second terminal (18) of the winding (6) and the second pole of the source of operating voltage, and that the second terminal (18) of the winding (6) is connected via a resistor (22) with another source of operating voltage (23) and, preferably via another resistor (24) to an input (25) of a control deice (15), and that a control input of the controllable switch (16) is connected to an output (21) of the control device (15).

BRIEF DESCRIPTION OF THE DRAWING

With the above and other objects and advantages in view, the present invention will become more clearly understood in connection with the detailed description of a preferred embodiment, when considered with the accompanying drawing, of which.

Identical parts in the figures have been provided with the same reference numbers.

DETAILED DESCRIPTION OF THE PREFERRED EMBODIMENT

Figure 1:
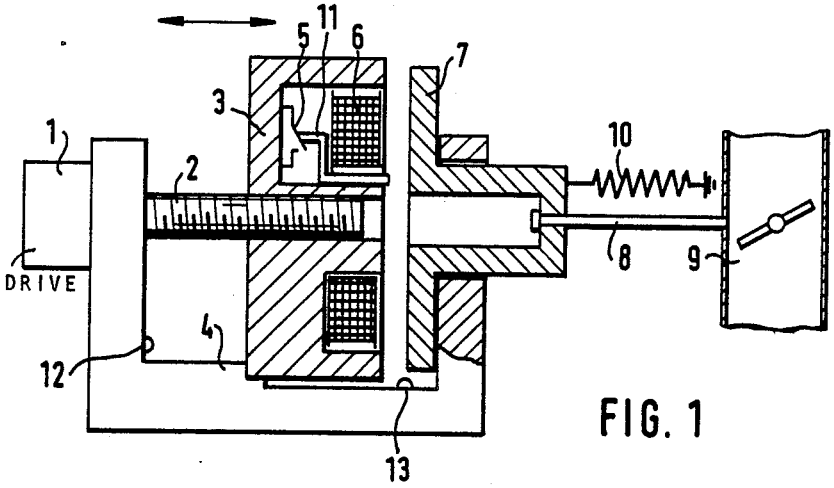
FIG. 1 is a diagrammatic showing of one embodiment.

The arrangement in accordance with FIG. 1 comprises a well-known electromotive drive 1 which comprises a motor and a gearing. The drive 1 operates through a threaded spindle 2. The threaded spindle 2 is in engagement with a plunger magnet 3 which is secured against turning by means of a guide element 4. By the turning of the threaded spindle 2 the plunger magnet 3 is moved in the direction indicated by the arrow.

The plunger magnet 3 has a coil 6 which produces a magnetic field when it is traversed by current. By this magnetic field an armature plate 7 can be attracted to the plunger magnet. The armature plate 7 is displaceably mounted and is connected by a pull cable 8 to a throttle valve device 9. In known manner, the throttle valve device 9 has a return spring 10 which is shown in FIG. 1 for purposes of illustration as acting directly on the armature plate 7. Within the plunger magnet 3 there is a switch 5 which is closed via a ram 11 when the armature plate 7 is in the direct vicinity of the plunger magnet.

Various embodiments of switches are suitable as switch 5, for instance those known as microswitches. However, reed switches which respond suitably to a change in the magnetic field upon attraction of the armature plate 7 are also suitable. Other switches 12, 13 serve in known manner as limit switches.

Figure 2:
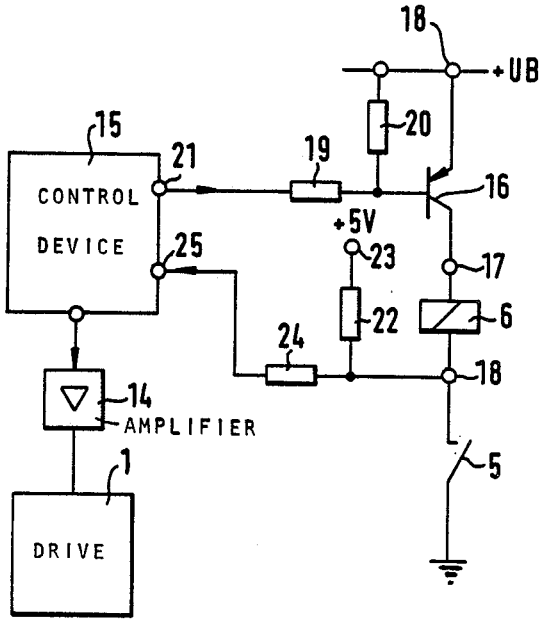
FIG. 2 is a circuit diagram in accordance with a further development of the invention.

The arrangement according to FIG. 1 shows a controlling element for the control or regulating of the engine power, such as used, for instance, in a speed governing system. In this case, the electromotive drive 1 is controlled via an output stage 14 (FIG. 2) in the direction of the desired control by a control device 15 which consists essentially of a microcomputer. Such control devices are known per se and need not be further described in connection with the present invention.

The coil 6 is connected via a controllable switch, provided by a transistor 16, to the positive terminal (+UB) of a source of operating voltage (not shown). The transistor 16 is preferably a power transistor. While a first terminal 17 of the winding 6 is connected to the collector of the transistor 16, a second terminal 18 of the winding 8 is connected to ground potential via the switch 5.

The base of the transistor 16 is connected via a voltage divider 19, 20 to an output 21 of the control device 15. The terminal 18 of the winding 6 is connected via a so-called pull-up resistor 22 to the positive terminal 23 of a stabilized source of operating voltage (+5V) and, via another resistor 24, to an input 25 of the control device 15.

If a signal for the connecting of the winding 6 is given off by the control device 15 via the output 21, this has no effect as long as the switch 5 is not closed. This is furthermore the case if the armature plate 7 is not in the direct vicinity of the plunger magnet 3.

Upon normal regulating or control operation the clutch is engaged and the switch 5 closed. The terminal 18 then has ground potential. The input 25 of the control device 15 is then also at ground potential. If the brake of the motor vehicle is, for instance, actuated, then the transistor 16 is brought into the non-conductive state by the control device 15 so that the current through the winding 6 and thus the magnetic field are disconnected. Except for the case that the plunger magnet 3 is in the outermost right-hand position, the armature plate 7 is then moved away from the plunger magnet by the spring 10. The switch 5 opens and a level of 5V, which can be evaluated as return-report signal, is present at the input 25 of the microcomputer.

Even if, for instance, the armature plate and the plunger magnet should be forcefully separated from each other by a defect in the region of the throttle valve and a movement towards the left, the switch is opened and a corresponding signal is fed to the input 25 of the control device 15, which signal is evaluated there as the report of a disturbance.

I claim:

1. In an electric controlling element for the power-setting element of a internal combustion engine in which the controlling element operates a power setting element such as a throttle valve, the controlling element including a drive device and a clutch, the clutch having an electromagnet and an armature, the clutch being arranged between the drive device and the power-setting element and wherein, upon passage of current to said electromagnet, the armature is attracted against the force of a spring to close the clutch, the improvement comprising switch means connected between the armature and the electromagnet, the switch means being actuated as a function of the distance between the electromagnet and the armature to signal a condition of the clutch.

2. An electric controlling element according to claim 1, wherein said drive device produces a linear movement.

3. An electric controlling element according to claim 2, wherein said drive device comprises an electric motor, and a gearing, output movement of the gearing being provided by a spindle.

4. An electric controlling element according to claim 1, wherein the electromagnet comprises a plunger magnet, and the armature is formed as an armature plate, the switch means being arranged in the plunger magnet.

5. An electric controlling element according to claim 1, wherein said switch means is conductive upon a contacting of the armature to the electromagnet.

6. An electric controlling element according to claim 1, wherein said switch means comprises a reed contact.

7. An electric controlling element according to claim 1, further comprising a controllable switch; and wherein said switch means is connected in series with a winding of the electromagnet and a controllable switch.

8. An electric controlling element according to claim 7, wherein operative with a first source and a second source of operating voltage and comprising further a first resistor, a second resistor, and a control device; and wherein a first pole of said first source of operating voltage is connected via said controllable switch to a first terminal of said winding, said switch means being arranged between a second terminal of said winding and a second pole of said first source of operating voltage; and a second terminal of said winding is connected via said first resistor with said second source of operating voltage and, via said second resistor to an input of said control device, a control input of the controllable switch being connected to an output of said control device.

* * * * *